US009995109B2

(12) United States Patent
Least et al.

(10) Patent No.: US 9,995,109 B2
(45) Date of Patent: Jun. 12, 2018

(54) INFLOW CONTROL DEVICE THAT CONTROLS FLUID THROUGH A TUBING WALL

(71) Applicant: Halliburton Energy Services, Inc., Houston, TX (US)

(72) Inventors: Brandon T. Least, Carrollton, TX (US); Stephen M. Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 200 days.

(21) Appl. No.: 14/912,340

(22) PCT Filed: Mar. 7, 2015

(86) PCT No.: PCT/US2015/019337
§ 371 (c)(1),
(2) Date: Feb. 16, 2016

(87) PCT Pub. No.: WO2016/144306
PCT Pub. Date: Sep. 15, 2016

(65) Prior Publication Data
US 2017/0254174 A1 Sep. 7, 2017

(51) Int. Cl.
*E21B 34/10* (2006.01)
*E21B 34/06* (2006.01)

(52) U.S. Cl.
CPC ..... *E21B 34/063* (2013.01); *E21B 34/10* (2013.01)

(58) Field of Classification Search
CPC ..... E21B 34/063; E21B 34/10
USPC ..... 166/374
See application file for complete search history.

(56) References Cited

U.S. PATENT DOCUMENTS

| | | | |
|---|---|---|---|
| 8,485,225 | B2 | 7/2013 | Veit |
| 2009/0151925 | A1 | 6/2009 | Richards et al. |
| 2011/0253391 | A1 | 10/2011 | Veit et al. |
| 2014/0338922 | A1 | 11/2014 | Lopez et al. |
| 2015/0027726 | A1 | 1/2015 | Bruce et al. |

FOREIGN PATENT DOCUMENTS

| | | | |
|---|---|---|---|
| WO | 2011067371 | A1 | 6/2011 |
| WO | 2015060838 | A1 | 4/2015 |

OTHER PUBLICATIONS

International Search Report and Written Opinion dated Oct. 1, 2015; PCT International Application No. PCT/US2015/019337.

*Primary Examiner* — Taras P Bemko
(74) *Attorney, Agent, or Firm* — McGuireWoods LLP

(57) ABSTRACT

An inflow control device (ICD) that may include a piston located in a flow passage, a barrier that prevents fluid flow through the ICD, and a shear device that prevents movement of the piston. A method of actuating one or more ICDs may include preventing actuation of the devices by maintaining a pressure in an interior of a well tool (or tubing string) below an actuation pressure of the devices, where each device may include a piston located within a flow passage, a barrier that prevents fluid flow through the ICD, and a shear device that initially prevents movement of the piston. The method may include increasing the pressure in the well tool (or tubing string) to be greater than or equal to the actuation pressure, thereby shearing the shear device and moving the piston.

20 Claims, 9 Drawing Sheets

INFLOW CONTROL DEVICE THAT CONTROLS FLUID THROUGH A TUBING WALL

TECHNICAL FIELD

A pressure-actuated inflow control device for controlling fluid flow between an interior and an exterior of a tubing string. The inflow control device can include a piston, a shear device, a barrier, and a flow passage, where the barrier provides pressure isolation between the interior and the exterior of the tubing string until sufficient pressure is applied to the interior of the tubing string. The increased pressure can deform the barrier, which maintains the pressure isolation until the pressure is reduced. The reduced pressure can at least partially remove the barrier and permit fluid flow through the inflow control device. According to certain embodiments, the inflow control device is used in an oil or gas well operation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
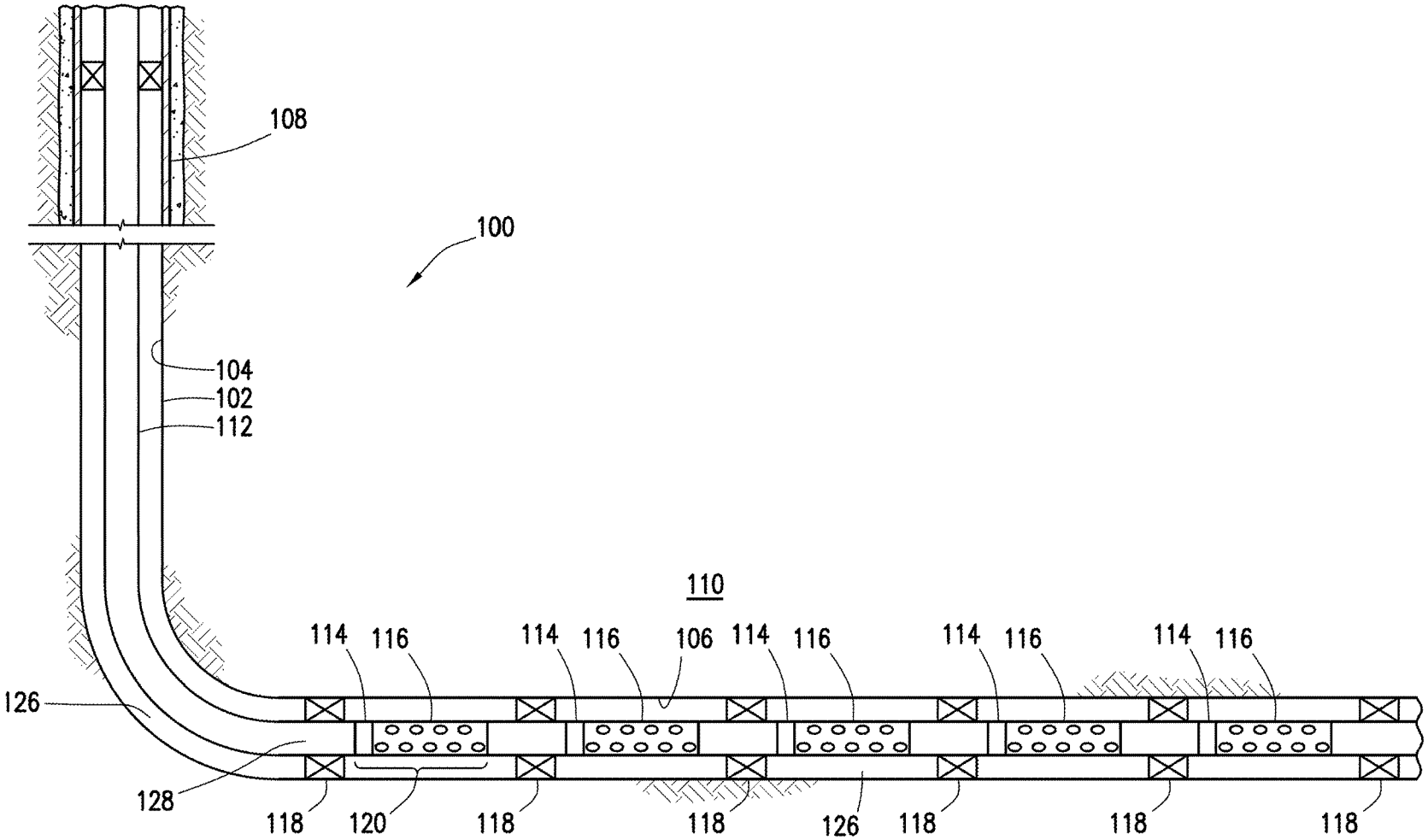
FIG. 1 depicts a schematic diagram of a well system with multiple inflow control devices (ICDs) according to certain embodiments.

Oil and gas hydrocarbons are naturally occurring in some subterranean formations. In the oil and gas industry, a subterranean formation containing oil or gas is referred to as a reservoir. A reservoir may be located under land or offshore. Reservoirs are typically located in the range of a few hundred feet (shallow reservoirs) to tens of thousands of feet (ultra-deep reservoirs). In order to produce oil or gas, a wellbore is drilled into a reservoir or adjacent to a reservoir. The oil, gas, or water produced from a reservoir is called a reservoir fluid. As used herein, a "fluid" is a substance having a continuous phase that tends to flow and to conform to the outline of its container when the substance is tested at a temperature of 71° F. (22° C.) and a pressure of one atmosphere (atm) (0.1 megapascals (MPa)). A fluid can be a liquid or gas.

A well can include, without limitation, an oil, gas, or water production well or an injection well. As used herein, a "well" includes at least one wellbore. A wellbore can include vertical, inclined, and horizontal portions, and it can be straight, curved, or branched. As used herein, the term "wellbore" includes any cased, and any encased, open-hole portion of the wellbore. The well can also include multiple wellbores, such as a main wellbore and lateral wellbores. As used herein, the term "wellbore" also includes a main wellbore as well as lateral wellbores that branch off from the main wellbore or from other lateral wellbores. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. Each zone of the formation can be isolated within the wellbore via the use of packers or other similar devices. At least one wellbore interval corresponds to each zone.

It is often desirable to produce a reservoir fluid from multiple zones of a formation or inject treatment fluids into the zones. This can be done by installing one or more inflow control devices (ICDs) in the wellbore at each of the zones. These ICDs can be hydraulically, pneumatically, electrically, optically, magnetically, and/or mechanically operated to selectively permit and prevent fluid flow into or out of the tubing string. However, individual control of multiple ICDs can require several control lines to each ICD, additional trips in the wellbore to operate individual ICDs (e.g., sliding sleeve valves, rotary actuated valves, etc.), and the ICDs can require more complex valves then simpler valves, such as rupture disks and check valves. These simpler valves may be used to reduce the complexity of the well system, but they can also have drawbacks. For example, check valves can be used to allow production flow from the formation into the tubing string, or injection flow from the tubing string into the formation, but not both.

Rupture disks can be used to prevent fluid communication between an internal flow passage in the tubing string and an annulus until it is desired to enable fluid communication between them. When a pressure differential across the rupture disks exceeds the preset rupture disk pressure rating, then at least some of the rupture disks will rupture, thereby enabling two-way fluid communication through at least some of the ICDs. However, when one or more of the rupture disks rupture, it becomes more difficult to maintain a required pressure differential across any of the non-ruptured disks, which can prevent some of these disks from rupturing. Verifying which disks ruptured and which disks did not rupture can also be a problem. Additional wellbore operations and/or trips in the wellbore may be needed to ensure that all of the disks have been ruptured for the desired zones of interest.

Rupture disks can include a barrier that isolates a pressure from one side of the rupture disk from an opposite side until the barrier ruptures. Rupture disks can allow multiple pressure cycles in the internal flow passage of the tubing string (e.g., setting packers, setting slips, operating a bottom hole assembly (BHA), etc.) without permitting fluid communication through the rupture disk until the preset pressure rating of the rupture disk is applied (e.g., by increasing pressure in the tubing string). However, it has been determined that rupture disks can deform during pressure cycles, even though the pressure remains below the preset pressure rating of the rupture disks. The deformation can weaken the disks which can cause them to rupture prematurely. Therefore, there is need to provide a system with multiple inflow control devices that utilize simpler valves and provide a means to ensure that all the valves have been actuated when it is desired to enable fluid flow through the ICDs. As used herein, "premature rupture" means that the barrier of the rupture disk ruptures at a pressure differential that is outside of a factory set pressure differential range, where the factory set pressure differential is the pressure differential at which the barrier of the disk is designed and manufactured to rupture.

It has been discovered that a structure can be used to reinforce a barrier of a rupture disk to substantially prevent deformation of the barrier, thereby preventing premature rupturing of the barrier. As used herein, "substantially prevent" means that the barrier of the rupture disk may possibly deform a small amount, but the deformation does not result in premature rupturing of the barrier. The structure can be held in a fixed position that provides structural reinforcement to the barrier until the preset pressure differential across the barrier is applied. When a first predetermined pressure differential, which is within the factory set pressure differential range, is applied across the barrier, the structure moves away from the barrier allowing the barrier to be ruptured at the first predetermined pressure differential, but not before the first predetermined pressure differential is applied.

According to certain embodiments, an inflow control device is provided that can include a body, a first flow passage which extends through the body, a piston reciprocally disposed in the first flow passage, a barrier that initially prevents fluid flow through the ICD, and a shear device that initially prevents movement of the piston relative to the body.

According to other embodiments, a method of actuating an inflow control device that can include preventing actuation of the inflow control device by maintaining a pressure in an interior of a well tool below an actuation pressure of the inflow control device, where the inflow control device can include (A) a body, (B) a flow passage which extends through the body, (C) a piston reciprocally disposed in the flow passage, (D) a barrier that initially prevents fluid flow through the inflow control device, and (E) a shear device that initially prevents movement of the piston relative to the body, and increasing the pressure in the well tool to be greater than or equal to the actuation pressure, thereby actuating the inflow control device by shearing the shear device and moving the piston in a first direction, where the increasing is preformed after the preventing.

According to yet other embodiments, a method of actuating an inflow control device in multiple well tools that can include preventing actuation of the inflow control devices by maintaining a pressure in an interior of the well tools below an actuation pressure of the inflow control device, and wherein each of the inflow control devices can include (A) a body, (B) a flow passage which extends through the body, (C) a piston reciprocally disposed in the flow passage, (D) a barrier that initially prevents fluid flow through the inflow control device, and (E) a shear device that initially prevents movement of the piston relative to the body, and increasing the pressure in the well tools to be greater than or equal to the actuation pressure, thereby actuating two or more of the inflow control devices by shearing the shear device in each of the two or more inflow control devices, where the increasing is preformed after the preventing.

Any discussion of the embodiments regarding the inflow control device or any component related to the inflow control device is intended to apply to all of the apparatus and method embodiments.

Turning to the Figures, FIG. 1 depicts a well system 100, which can include at least one wellbore 102. The subterranean formation 110 can be a portion of a reservoir or adjacent to a reservoir. The wellbore 102 can include a substantially vertical section 104 and a substantially horizontal section 106. The vertical section 104 can include a casing 108 cemented at an upper portion of the vertical section 104. The horizontal section 106 can extend through a subterranean formation 110 with one or more production zones without having a casing 108 (e.g., open-hole wellbore). FIG. 1 depicts multiple well tools 120 that can each include an ICD 114 and a screen assembly 116. However, many other configurations of these items are possible.

A tubing assembly can include a tubing string 112 or pipe extending from the surface within wellbore 102. The flow passage 128 can provide a conduit for formation fluids to travel from the horizontal section 106 to the surface. Multiple well tools 120 can each include an ICD 114 and a screen assembly 116. The well tools 120 can be positioned along the tubing string 112 in various production intervals. On each side of the well tool 120 is a packer 118 that can provide a fluid seal between the tubing string 112 and the wall of the wellbore 102, thereby preventing fluid flow through the annulus 126 between the production zones. The ICD 114 can control the fluid that flows through the screen assemblies 116. However, it is not required that the ICDs 114 control fluid flow through the screen assemblies 116. The ICD 114 can merely control fluid flow through a wall of the tubing string without the fluid flowing through a screen assembly 116. For example, the ICDs 114 can be used to control fluid flow through a wall of the tubing string 112 (or mandrel of the well tool 120) to set a packer 118 or extend slips (not shown) into engagement with the tubing string's 112 inner surface. Also, the ICDs 114 are not required to be positioned in the tubing string 112 adjacent a screen assembly 116. It should be clearly understood that any number of zones may be included in the well system 100 with any number of ICDs 114 per zone and any number (including zero) of screen assemblies 116 per zone. Therefore, the current disclosure is not limited by the number of zones, ICDs 114, or screen assemblies 116 as shown in FIG. 1.

Therefore, it should be clearly understood that the well system 100 illustrated in the drawings and described herein is merely one example of a wide variety of well systems in which certain embodiments can be utilized. It should be clearly understood that the principles of this disclosure are not limited to any of the details of the well system 100, or components thereof, depicted in the drawings or described herein. Furthermore, the well system 100 can include other components not depicted in the drawing. For example, the well system 100 can include perforating gun assemblies, anchoring slips, isolation valves, etc.

Figure 2A:
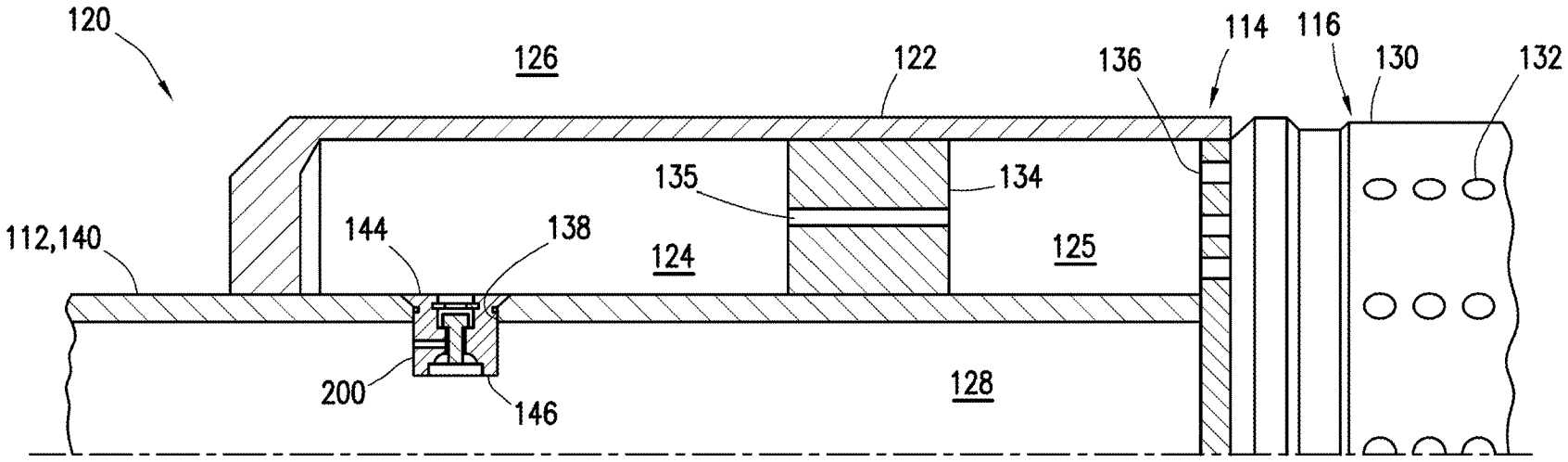
FIGS. 2A, 2B, and 3 depict a partial cross-sectional view of an ICD according to certain embodiments with an outer housing.

FIG. 2A depicts a partial cross-sectional view of an end of the well tool 120. The well tool 120 can include an ICD 114 that is positioned adjacent to a screen assembly 116 with ports 136 that provide fluid communication between the ICD 114 and the screen assembly 116. The screen assembly 116 can include a shroud 130 with perforations 132 for filtering fluid flow through the screen assembly 116. Fluid can flow from the flow passage 128, through the ICD 114 and into the screen assembly 116 (e.g., for injection/treatment operations, for flowing an activating agent to the screen assembly to degrade temporary plug material, etc.), or from the screen assembly 116, through the ICD 114, and into the flow passage 128 (e.g., for production operations, gravel packing operations, etc.). The ICD 114 can include a temporary plug 200 that can be secured in an opening 138 in the wall of the tubing string 112, in an opening 138 in the wall of a mandrel 140 of the well tool 120, which is interconnected in the tubing string 112, or in an opening in any other pressure bearing wall. The ICD 114 may also include other features, such as a flow restrictor 134 with a flow path 135, through which fluid flow through the well tool assembly 120 is restricted. FIG. 2A depicts the flow restrictor 134 positioned between the first and second chambers 124, 125, which can be annular chambers contained within a housing 122 of the ICD 114. However, it is not required that the ICD 114 includes a housing 122 and a flow restrictor 134. In certain embodiments, the ICD 114 can include only the temporary plug 200.

Figure 2B:
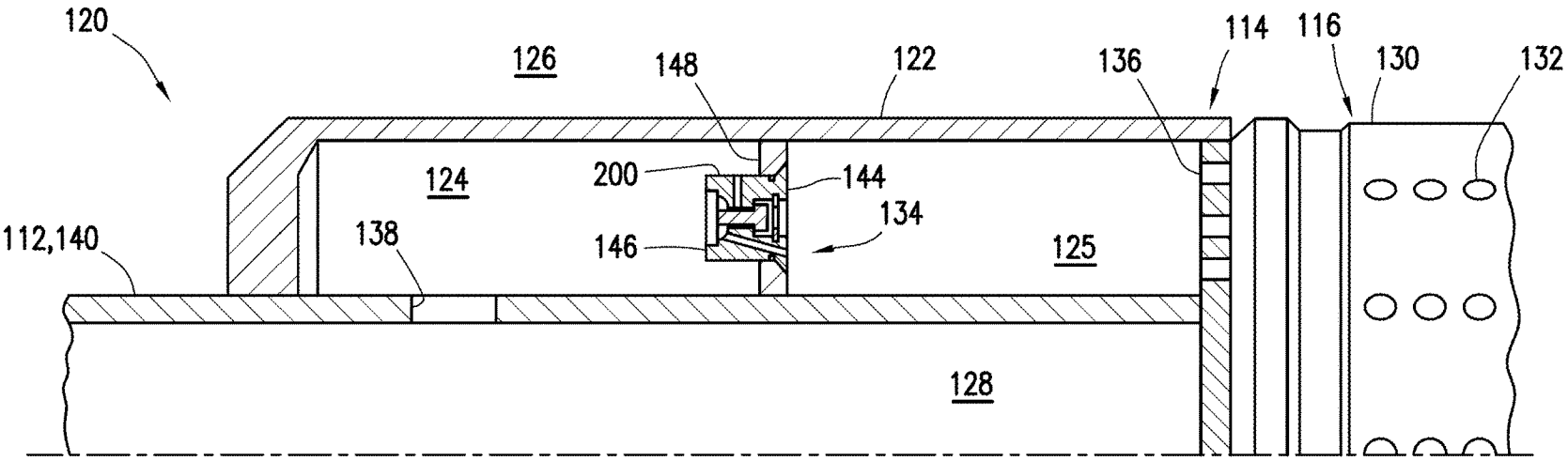

FIG. 2B depicts another partial cross-sectional view of an end of the well tool 120. FIG. 2B is very similar to FIG. 2A, except that the flow restrictor 134 includes a plug 200 instead of the flow path 135. The plug 200 is secured in an opening in an annular ring 148, where the ring 148 pressure isolates the first chamber 124 from the second chamber 125. The annular ring 148 can include one or more plugs 200 spaced apart around the ring 148. Multiple plugs 200 in the annular ring 148 can provide additional fluid flow paths through the well tool 120. FIG. 2B depicts the plug 200 installed in an orientation that is actuated by an actuation pressure applied from the internal flow passage 128. However, the plug 200 may be installed in a reverse orientation that is actuated by an actuation pressure applied from the annulus 126. Either one of these plug 200 orientations can support either injection or production operations. It should be clearly understood that the plugs 200 in FIGS. 2A and 3 can also be installed in either orientation. It should be clearly understood that the plug 200 can be installed in other tool configurations. For example, the plug 200 can be installed in a pressure bearing wall of a side-pocket mandrel to control fluid flow through the side-pocket mandrel.

Figure 3:
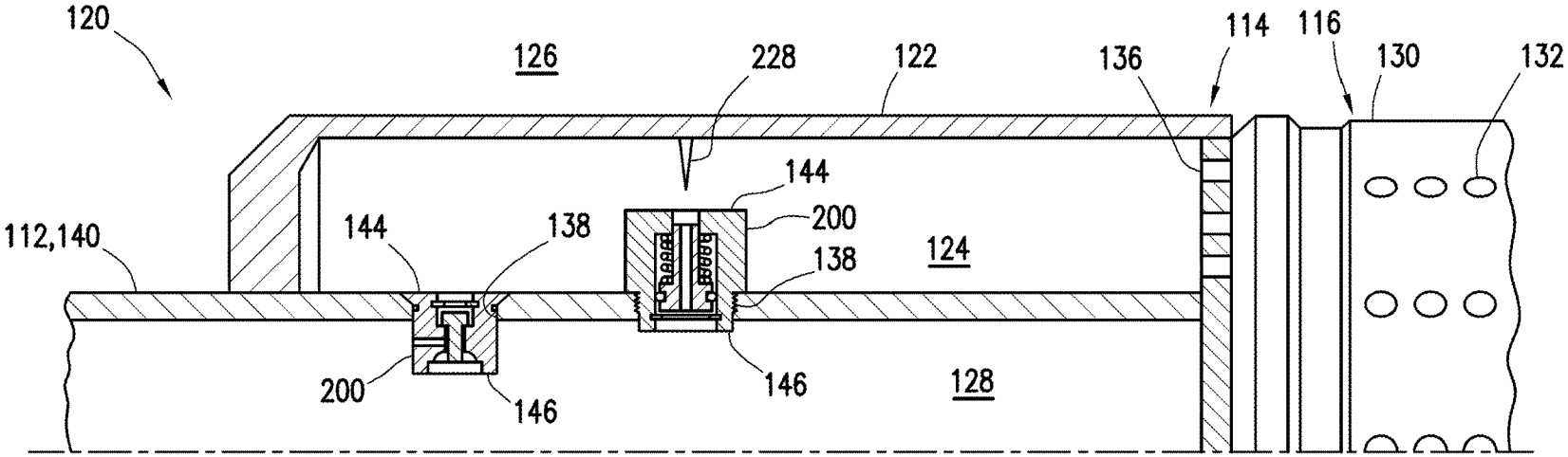

FIG. 3 depicts another partial cross-sectional view of an end of the well tool 120. FIG. 3 is very similar to FIG. 2A, except that there is no flow restrictor 134, only one annular chamber 124, and most notably, there are at least two various embodiments of the temporary plug 200. One plug 200 is secured in a wall of the tubing string 112 (or mandrel 140) with an end extending into the flow passage 128. This plug 200 includes a structure (e.g., a piston) that provides reinforcement to a barrier that deforms when a first predetermined pressure is applied to the flow passage 128. The other plug 200 can also be similarly secured in a wall of the tubing string 112 (or mandrel 140) with an end that only slightly extends (if at all) into the flow passage 128. This plug 200 is depicted as extending into the chamber 124 and aligned with a protrusion 228 mounted to an inner surface of the housing 122. When the first predetermined pressure is applied to the flow passage 128, a piston is released and the protrusion is forced through a barrier on the end of the piston in response to the movement of the piston. Therefore, multiple plugs 200 can be used in an ICD 114, which can also include multiple configurations of the plug 200.

Figure 4:
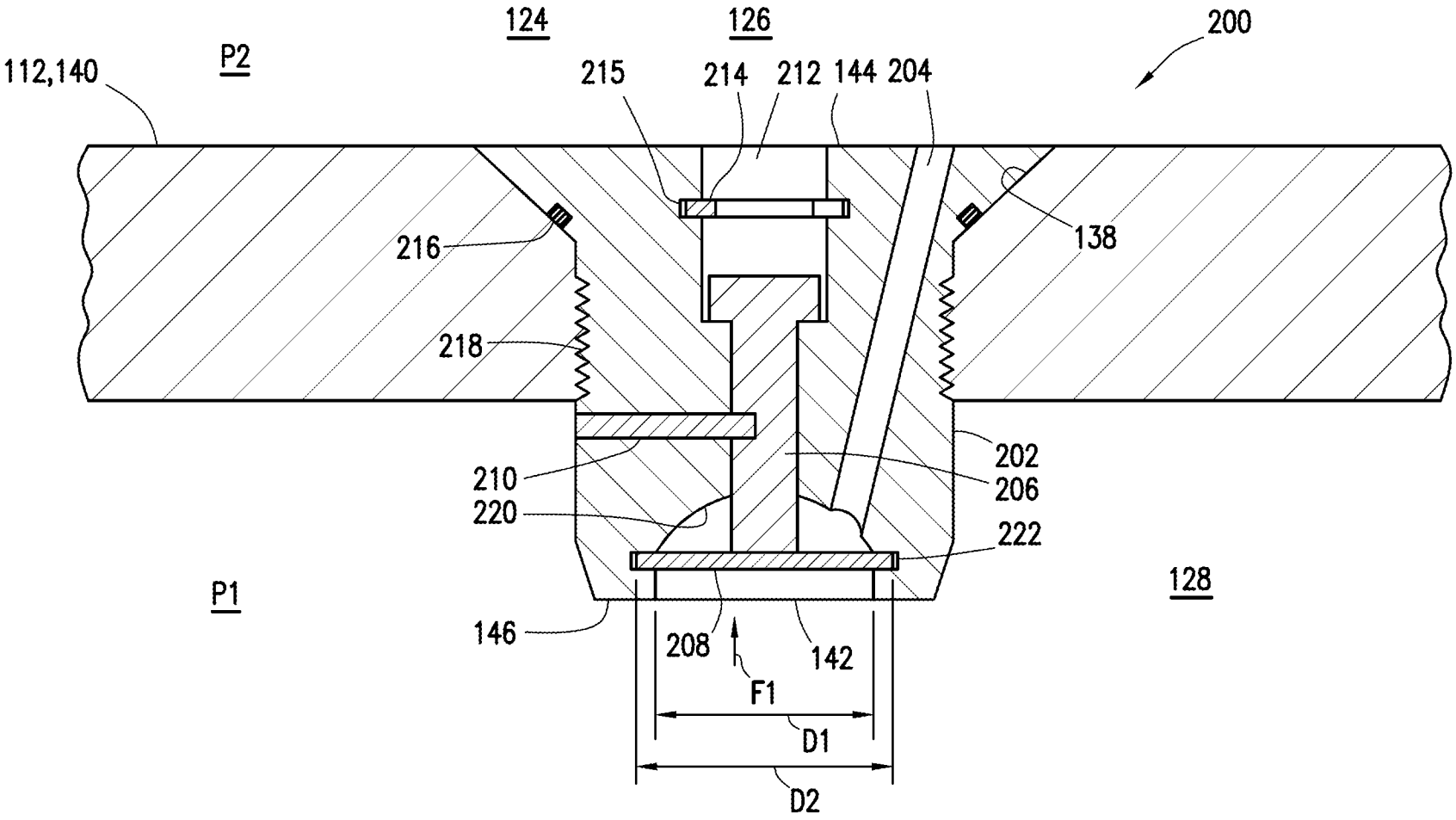
FIGS. 4-5 depict a partial cross-sectional view of a plug that can be used as the ICD or as a component of the ICD.
Figure 5:
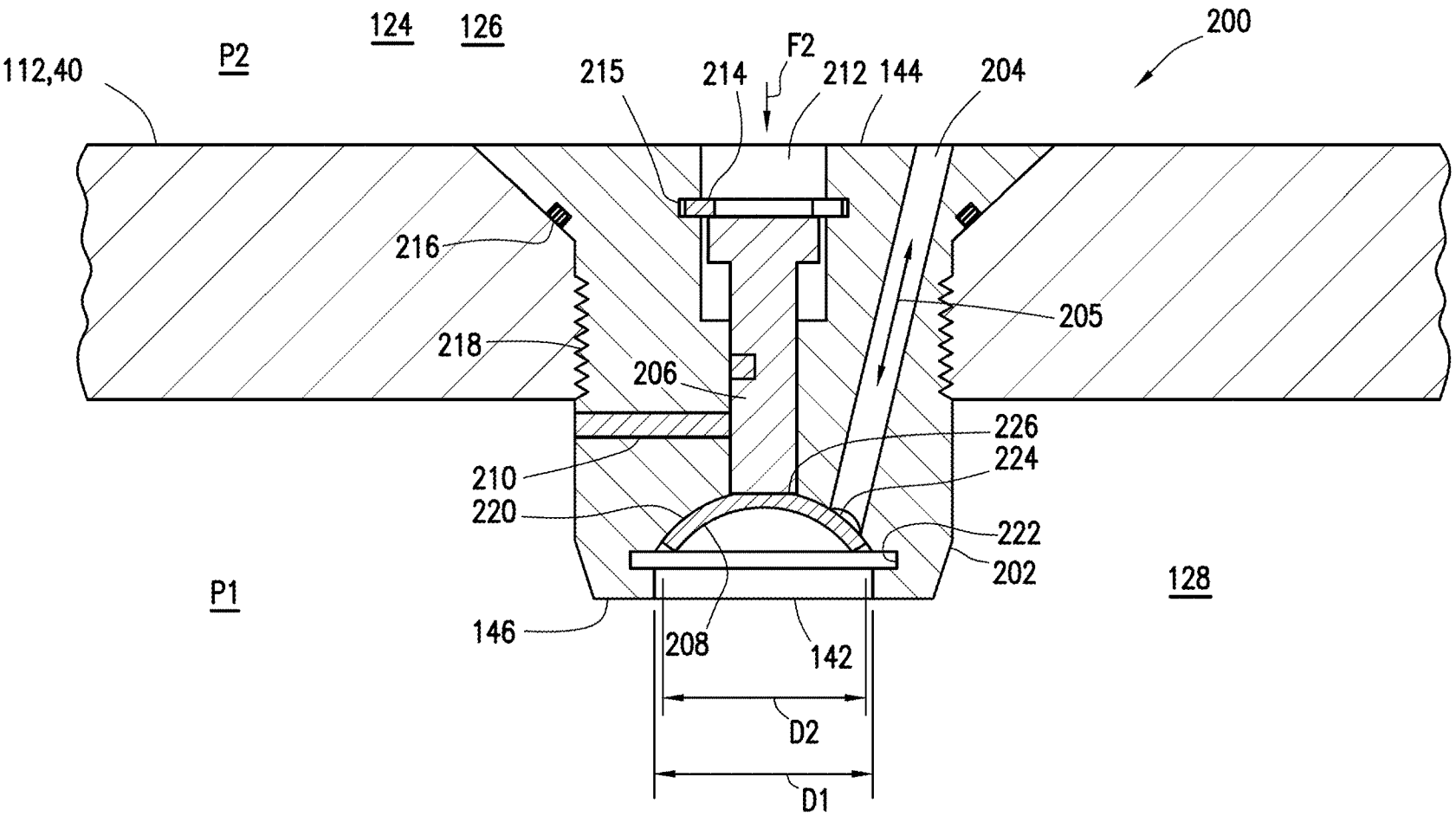

FIGS. 4-5 depict a cross-sectional view of a certain embodiment of a temporary plug 200. The plug 200 can include a body 202, a first flow passage 212, a second flow passage 204, a piston (or structure) 206, a barrier 208, and a shear device 210. The body 202 can be secured in an opening 138 of the tubing string 112 (or mandrel 140) by threading the body into threads 218 (as seen in FIGS. 4-8), by welding the plug 200 in the opening 138, and/or by any suitable securing means that will prevent removal of the plug 200 from the opening 138 when a first predetermined pressure is applied to the flow passage 128. A seal 216 can be used to prevent fluid flow between the plug 200 and the opening 138. However, the seal 216 may not be required if the threads 218 provide a threaded connection that is sufficient to prevent fluid flow and pressure loss past the plug 200.

The piston 206 can be reciprocally disposed in the first flow passage 212 and can provide reinforcement to the barrier 208, thereby preventing any substantial deformation of the barrier 208 as pressure P1 in the flow passage 128 is adjusted to pressures that are below the predetermined pressure. A shear device 210 (e.g., shear bolt, shear ring, shear pin, etc.) prevents movement of the piston 206 within the first flow passage 212, until the first predetermined pressure is applied to the flow passage 128. When the pressure P1 is increased to the first predetermined pressure, a pressure differential across the plug 200 causes a force F1, which is applied to the barrier 208 and the piston 206, to shear the shear device 210, thereby releasing the piston 206 to move freely within the first flow passage 212. When the shear device 210 is sheared, the piston 206 is forced against the snap ring 214 which can be disposed in a recess 215. The snap ring 214 can prevent the piston 206 from exiting the first flow passage 212. However, it should be clearly understood that any other suitable means may be used to stop the piston 206 from traveling out of the first flow passage 212, such as a cover (with holes) that is welded to the top 144 of the plug 200, a pin disposed in a recess in the first flow passage, etc.

The snap ring (or other stopping means) may also be used to maintain a reinforcement against the deformed barrier 208, thereby preventing the deformed barrier 208 from further deforming into the first flow passage 212 past the generally concave surface 220. Continued deformation of the barrier 208 may not be desirable because it can result in fluid communication through the second flow passage 204 prior to the barriers 208 in other plugs 200 being actuated (i.e., deformed against the concave surface 220). It should also be understood that a stop may not be necessary at all. The piston 206 can be allowed to exit the first flow passage 212 after the shear device 210 is sheared. When the shear device 210 is sheared by the application of the first predetermined pressure, then the piston 206 moves in a first direction along the first flow passage 212. Without a stop (such as a snap ring, recessed pin, etc.), the piston 206 is free to continue moving in the first direction until it exits the first flow passage 212. The applied force F1, and an abrupt release of the piston 206 in response to the sheared device 210, can cause the piston 206 to be elected from the first flow passage 212. In this configuration, the piston 206 would not move in a second direction after the first predetermined pressure is removed because it is removed from the first flow passage 212. This can result in additional flow through the ICD 114 with both the first and second flow passages 212, 204 are free of obstructions.

Referring again to FIGS. 4-5, the movement of the piston 206 removes the reinforcement from the barrier 208 and allows the barrier 208 to deform against the generally concave surface 220, which removes the barrier 208 from the recess 222. The deformed barrier 208 continues to prevent fluid flow through the first and second flow passages 212, 204, and allows the pressure P1 in the flow passage 128 to be maintained at or above the first predetermined pressure. Therefore, if multiple plugs 200 are utilized in the well system 100, the pressure P1 can be maintained at or above the first predetermined pressure to ensure that all plugs 200 are actuated by moving each piston 206 and deforming each barrier 208, assuming all plugs 200 in the system are actuated at the same preset pressure differential. Multiple plugs 200 with varied preset pressure differentials can be used, but this can require pressure-isolating regions of the internal flow passage 128 by using bridge plugs, isolation valves, etc. to maintain the desired pressures in the regions for actuating the particular group of plugs 200.

FIG. 5 depicts the plug 200 with the shear device 210 being sheared, and the piston 206 being moved against the snap ring 214, with the deformed barrier 208 providing a blockage 226 in the first flow passage 212 and a blockage 224 in the second flow passage 204. Blockages 226, 224 continue to prevent fluid flow through the first and second flow passages 212, 204, respectively, while a positive pressure differential exists between pressure P1 in the flow passage 128 (which is the interior of the tubing string 112 or the well tool 120) and pressure P2 in the annulus 126 and/or the chamber 124 (which is the exterior of the tubing string 112 or the well tool 120).

When it is desired to allow fluid flow through the plug 200 (or inflow control device 114), then the pressure P1 in the flow passage 128 can be reduced to a second predetermined pressure, which causes the pressure differential across the plug 200 to reduce the force F1 to a level that allows the barrier to fall out of or be dispensed from the plug 200. The pressure P1 can be reduced to cause a pressure differential between P2 and P1, thereby causing force F2 to be applied to the piston. 206 and barrier 208 through the first flow passage 212. Force F2 urges the piston 206 to move in a second direction which is opposite of the first direction, thereby assisting in dispensing the deformed barrier 208 from the plug 200. Alternatively, or in addition to, the force F2 can be caused by fluid flow through the first flow passage 212, which can also urge the piston 206 to move in the second direction.

FIG. 4 depicts the barrier 208 as having a diameter D2 that is greater than a diameter D1 of an opening 142 in the bottom end 146 of the plug 200. This prevents the barrier 208 from being dispensed from the opening 142 prior to the barrier 208 being deformed. However, as depicted in FIG. 5, the diameter D2 of the barrier 208 has been reduced to a diameter that is less than the diameter D1. Therefore, when the force F1 is reduced to a level that allows the deformed barrier 208 to fall away from the concave surface 220, the barrier 208 can continue to fall out of or be dispensed from the plug 200, thereby removing blockages 226, 224 from the first and second flow passages 212, 204, respectively. With the blockages 226, 224 removed, fluid is permitted to flow through the first and second flow passages 212, 204. In FIG. 5, arrows 205 depict fluid flow in either direction in the second flow passage 204. It should be clearly understood that fluid may also flow in either direction in the first flow passage 212 by flowing past the piston 206. Additionally, another flow passage (not shown) can be provided through the piston 206, allowing additional fluid flow through the plug 200 when the barrier is dispensed from the plug 200.

It should be clearly understood that many configurations of flow passages through the plug can be utilized. For example, if a flow passage through the piston 206 is provided, then the flow passage 204 may not be needed. Therefore, the second flow passage 204 can be a flow passage through the piston 206, instead of the flow passage as seen in FIGS. 4-5. Also, FIGS. 4-5 depict the second flow passage 204 as extending from the concave surface 220 to a top 144 end of the plug 200. However, if the plug 200 is mounted in the opening 138 similar to the plug 200 in FIG. 3 (the one that extends into the chamber 124), then the second flow passage 204 may extend from the concave surface 220 to a sidewall of the plug 200 instead of to the top 144. These flow passages 212, 204 can be of any configuration so long as they are blocked while the plug(s) 200 are being actuated and are opened when the pressure differential across the plug 200 is reduced to allow the barrier 208 to be removed from the plug 200.

FIGS. 4-5 depict the piston 206 as having a generally T-shaped cross section, where the diameter of one end is larger than a diameter of an opposite end. However, it should be clearly understood that the piston 206 can be many different shapes. For example, the piston 206 can be a rod with a continuous cross section along its length, where the cross section can be circular, oval, rectangular, square, octagonal, star-shaped, triangular, etc. The rod can provide reinforcement to the barrier 208, with a shear device 210 preventing movement of the rod within the first flow passage 212. When F1 causes the shear device 210 to shear, the rod can move in a first direction to engage a stop (such as snap ring 214 or another type of stop), allowing the barrier 208 to deform. When the pressure P1 is reduced to the second predetermined pressure and the barrier 208 is dispensed from the plug 200, the rod may also be dispensed from the first flow passage 212, thereby enabling even greater flow of fluid through the plug 200.

Figure 6:
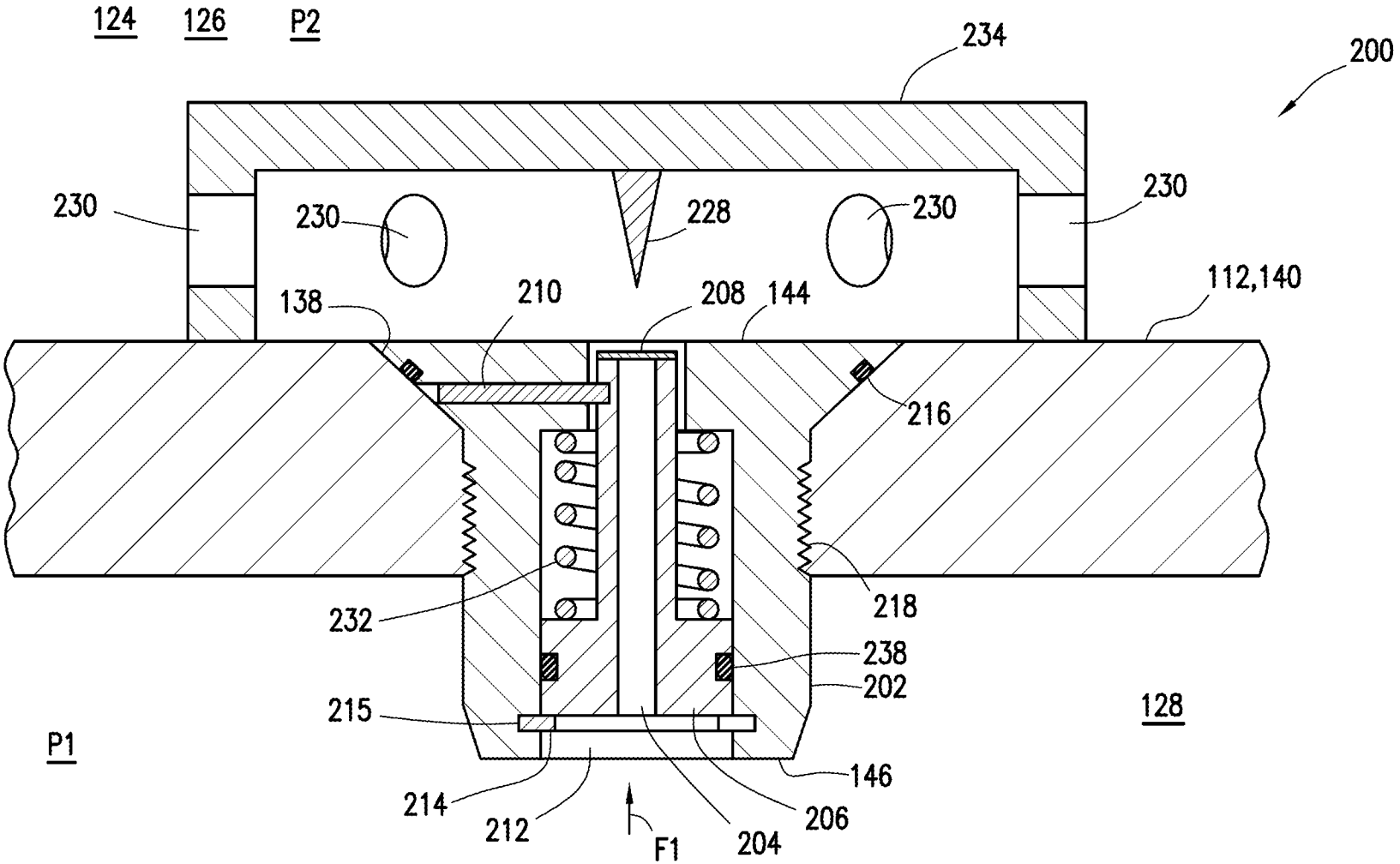
FIGS. 6-8 depict a partial cross-sectional view of another plug that can be used as the ICD or as a component of the ICD.
Figure 7:
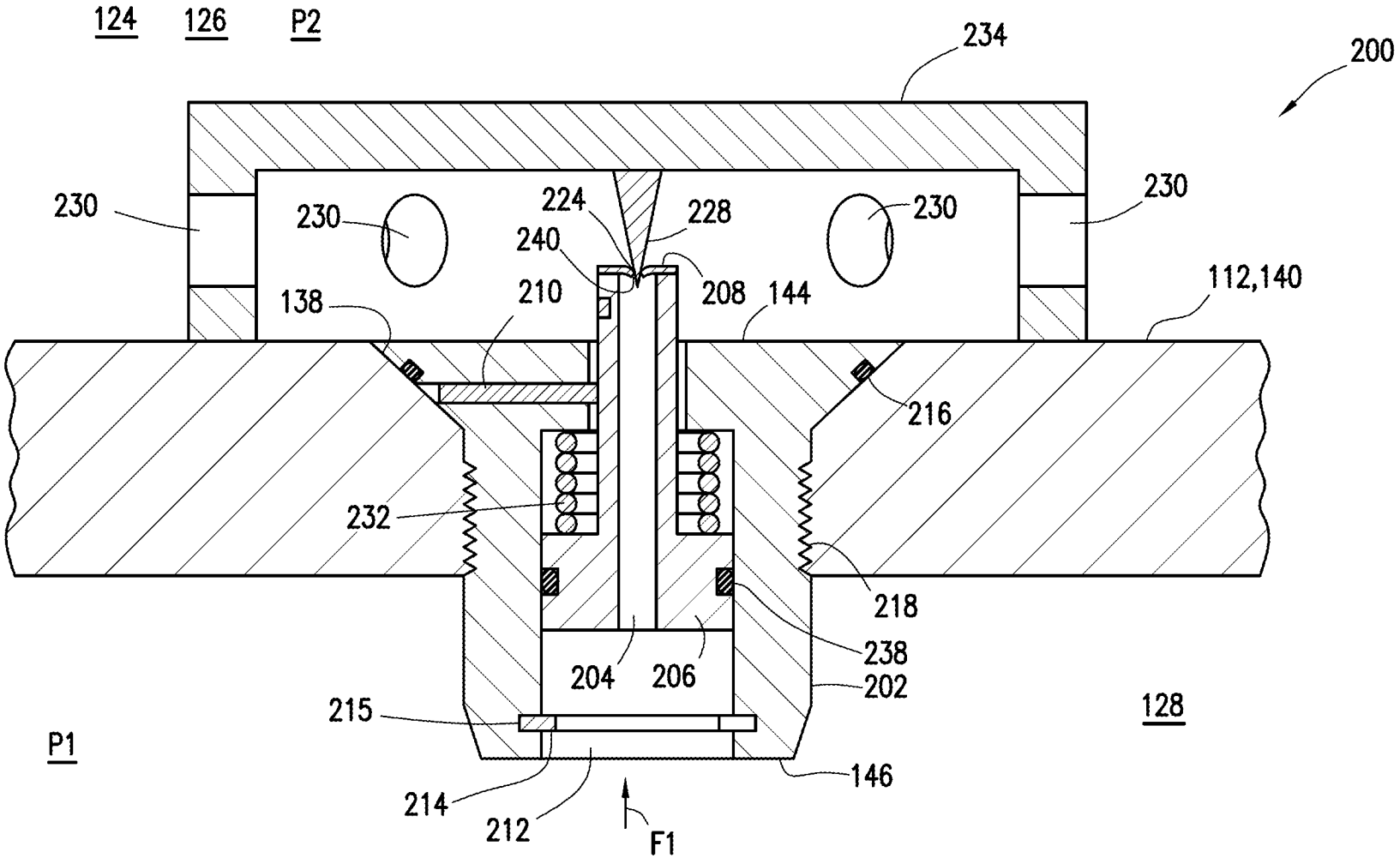
Figure 8:
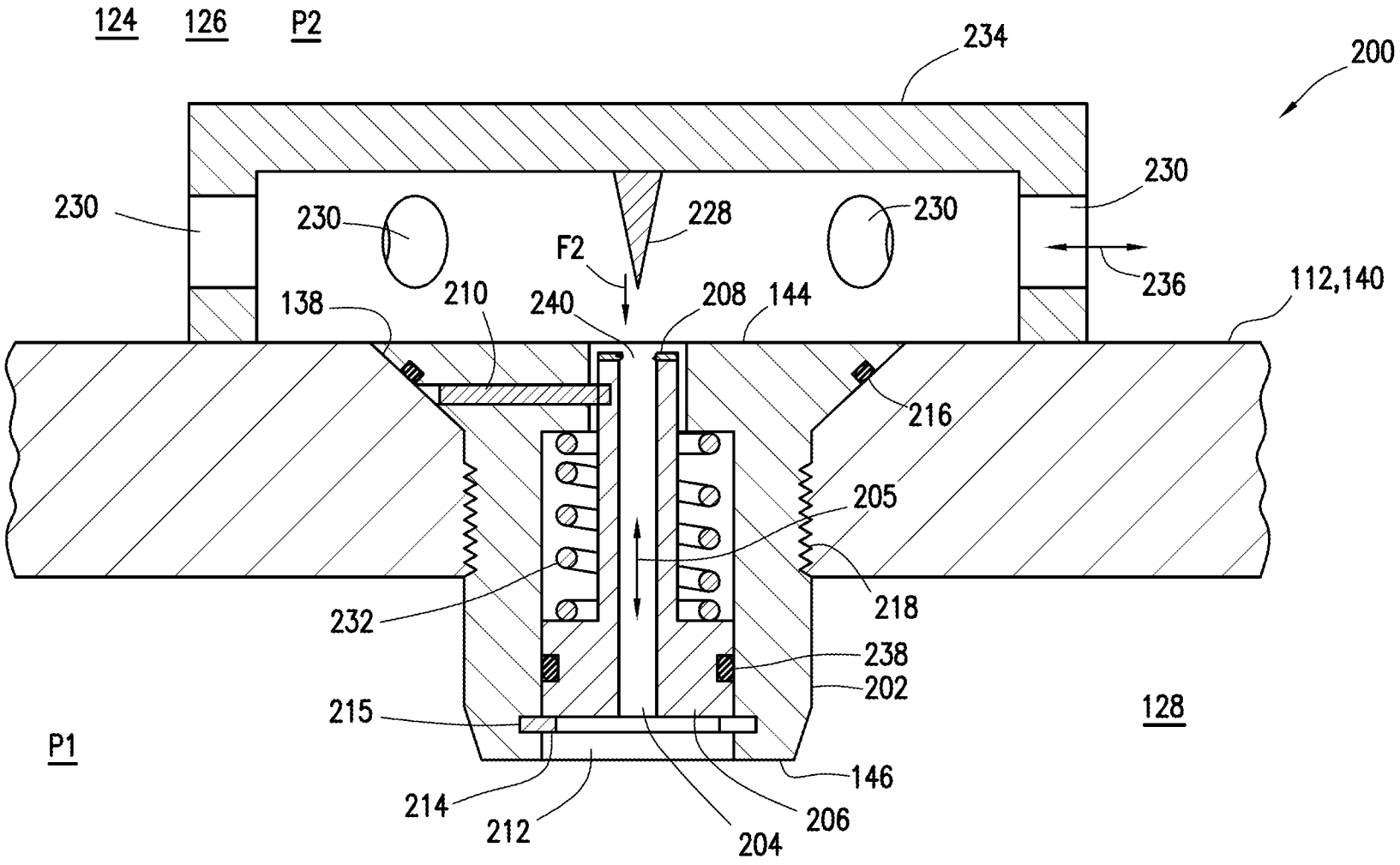

FIGS. 6-8 depict a cross-sectional view of another certain embodiment of a temporary plug 200. The plug 200 can include a body 202, a first flow passage 212, a second flow passage 204, a piston 206, a barrier 208, and a shear device 210. The body 202 can be secured in an opening 138 of the tubing string 112 or mandrel 140 by any suitable securing means (e.g., threading, welding, etc.) that will prevent removal of the plug from the opening 138 when a first predetermined (or actuation) pressure is applied to the flow passage 128. The plug 200 may extend into the flow passage 128, as seen in FIGS. 6-8, or it may extend into the chamber 124, as seen in FIG. 3. This clearly shows that the plug 200 can be installed into the opening 138 with a portion of the plug 200 extending into the flow passage 128, extending into the chamber 124, or at least partially extending into both. One benefit of the plug 200 extending into the flow passage 128 is that a shearing tool can be used to shear off the bottom end 146 of the plug 200 that extends into the flow passage 128, thereby enabling flow through the plug 200 without having to deform or rupture the barrier 208. This may be necessary if pressure in the flow passage 128 cannot be increased to the actuation pressure of the plug 200, thereby preventing actuation of the plug 200. Actuation of the plug includes shearing the shear device 210 and moving the piston 206 in a first direction in the first flow passage 212.

The piston 206 can be reciprocally disposed in the first flow passage 212 with a biasing device 232 that urges the piston 206 against a snap ring 214 that is located proximate to the end 146 of the plug 200 that extends into the flow passage 128. The piston 206 can also include one or more seals 238 that seal between an inner bore of the first flow passage 212 and the outer surface of the piston 206. The piston 206 can include the second flow passage 204 that extends through the piston 206. The barrier 208 seals off the second flow passage 204 at the top end of the piston 206. Therefore, the barrier 208 can work in cooperation with the seals 216, 238 to at least initially prevent pressure and fluid communication through the plug 200. A shear device 210 (e.g., shear bolt, shear ring, shear pin, etc.) prevents movement of the piston 206 within the first flow passage 212 until the actuation pressure is applied to the flow passage 128. When the pressure P1 is increased to the actuation pressure, a pressure differential across the plug 200 causes a force F1, which is applied to the barrier 208 and the piston 206, to shear the shear device 210, thereby releasing the piston 206 to move freely within the first flow passage 212. When the shear device 210 is sheared, the piston 206 is moved away from the snap ring 214 and compresses the biasing device 232. FIGS. 6-8 show the biasing device 232 as a spring, but it should be clearly understood that any biasing device may be used to urge the piston 206 toward the snap ring 214.

When the force F1 shears the shear device 210, the piston 206 is abruptly moved away from the snap ring 214, thereby compressing the biasing device 232 and causing a protrusion 228 to puncture the barrier 208. The protrusion 228 is shown to be an inverted cone, but any shape can be used, as long as the protrusion 228 can puncture the barrier 208 and maintain a pressure seal between the punctured barrier 208 until the pressure P1 is reduced to a second predetermined pressure. The puncture 228 can be mounted to a structure 234, which overlays the plug 200 and which aligns the protrusion 228 with the second flow passage 204. The structure 234 can include flow ports (e.g., ports 230) to allow fluid flowing through the plug 200 to flow through ports 230 as indicated by arrows 236. However, it should be clearly understood that the structure 234 is not necessary. As seen in FIG. 3, the protrusion can be mounted to the inner surface of the housing 122 without using a separate structure 234.

When the shear device 210 is sheared, and the barrier 208 is punctured, the pressure P1 can be maintained at the actuation pressure to ensure that any other plugs 200 are actuated before the pressure P1 is reduced. FIG. 7 depicts the barrier 208 punctured by the protrusion 228. After ensuring that all plugs 200 have been actuated, the pressure P1 can be reduced to a second predetermined pressure that no longer overcomes the biasing force of the biasing device 232. At the second predetermined pressure, the biasing device 232 begins to move the piston 206 in a second direction, which is toward the snap ring 214 and away from the protrusion 228. This removes the protrusion 228 from the barrier 208, thereby removing a blockage 224 from the flow passage 204 and leaving an opening 240 in the barrier 208 through which fluid can flow.

FIG. 8 depicts that the piston 206 is once again urged against the snap ring 214 by the biasing device 232. The barrier 208 is punctured, forming an opening 240 in the barrier through which fluid can flow. The plug 200 has actuated and blockage removed from the second flow passage 204 to allow fluid flow in either direction as indicated by arrows 205.

Therefore, the present system is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps.

Whenever a numerical range with a lower limit and an upper limit is disclosed, any number and any included range falling within the range is specifically disclosed. In particular, every range of values (of the form, "from about a to about b," "from approximately a-b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. An inflow control device comprising:

a body;

a first flow passage which extends through the body;

a piston reciprocally located within the first flow passage;

a barrier that initially prevents fluid flow through the inflow control device; and a shear device that initially prevents movement of the piston relative to the body, wherein the shear device is sheared when a pressure in a tubing string is increased to a first predetermined pressure that moves the piston in a first direction in response to the shear device being sheared to cause:

(a) deforming the barrier in response to the movement of the piston, or (b) forcing a protrusion through the barrier, thereby puncturing the barrier, and wherein pressure isolation between the interior and the exterior of the tubing string is maintained while the protrusion remains in the barrier.

2. The inflow control device according to claim 1, wherein the body is secured in an opening in a pressure bearing wall.

3. The inflow control device according to claim 1, wherein a blockage to fluid flow through the inflow control device is removed in response to a second predetermined pressure being applied in the tubing string, wherein the second predetermined pressure is less than the first predetermined pressure.

4. The inflow control device according to claim 1, wherein the barrier maintains pressure isolation between the interior and the exterior of the tubing string until the pressure is reduced to a second predetermined pressure.

5. The inflow control device according to claim 4, wherein a blockage to fluid flow through the inflow control device is removed when the pressure is reduced to the second predetermined pressure, and wherein the application of the second predetermined pressure dispenses the barrier from the inflow control device, retracts a protrusion from the barrier, or combinations thereof.

6. The inflow control device according to claim 1, wherein fluid flow through the first flow passage moves the piston in a second direction which is opposite of the first direction when the pressure is reduced to a second predetermined pressure.

7. The inflow control device according to claim 1, wherein a biasing device moves the piston in a second direction which is opposite of the first direction when the pressure is reduced to a second predetermined pressure.

8. The inflow control device according to claim 7, wherein the protrusion is removed from the barrier in response to the movement of the piston in the second direction, and wherein fluid flow through the barrier is permitted when the protrusion is removed from the barrier.

9. The inflow control device according to claim 1, further comprising a second flow passage which extends through at least one of the piston and the body.

10. The inflow control device according to claim 9, wherein fluid flow through the second flow passage is initially prevented by the barrier, and wherein fluid flow through the second flow passage is permitted when the barrier is removed.

11. A method of actuating an inflow control device, the method comprising:

preventing actuation of the inflow control device by maintaining a pressure in an interior of a well tool below an actuation pressure of the inflow control device, wherein the inflow control device comprises:

(A) a body;

(B) a flow passage which extends through the body;

(C) a piston reciprocally located within the flow passage;

(D) a barrier that initially prevents fluid flow through the inflow control device; and (E) a shear device that initially prevents movement of the piston relative to the body;

increasing the pressure in the well tool to be greater than or equal to the actuation pressure, thereby actuating the inflow control device by shearing the shear device and moving the piston in a first direction, wherein the step of increasing is performed after the step of preventing; and decreasing the pressure in the well tool, thereby removing a blockage in the inflow control device and permitting fluid flow through the inflow control device in response to the removal of the blockage, wherein the step of decreasing is performed after the step of increasing and the step of decreasing comprises at least one of: dispensing the barrier from the inflow control device and retracting a protrusion from the barrier that was punctured by the protrusion when the actuation pressure was applied to the interior of the well tool.

12. The method according to claim 11, wherein the step of preventing further comprises cycling the pressure in the well tool between at least a first pressure and a second pressure, wherein the first and second pressures are below the actuation pressure.

13. The method according to claim 11, wherein the step of increasing further comprises at least one of: deforming the barrier; and puncturing the barrier with a protrusion, wherein the deforming, puncturing, or both are performed while maintaining a pressure isolation between an interior and an exterior of the well tool.

14. A method of actuating an inflow control device in each of multiple well tools, the method comprising:

preventing actuation of the inflow control devices by maintaining a pressure in an interior of the well tools below an actuation pressure of the inflow control devices, and wherein each of the inflow control devices comprises:

(A) a body;

(B) a first flow passage which extends through the body;

(C) a piston reciprocally located within the first flow passage;

(D) a barrier that initially prevents fluid flow through the inflow control device; and (E) a shear device that initially prevents movement of the piston relative to the body; and increasing the pressure in the well tools to be greater than or equal to the actuation pressure, thereby actuating two or more of the inflow control devices by shearing the shear device in each of the two or more inflow control devices, wherein the step of increasing is performed after the step of preventing and the step of increasing comprises deforming the barrier in the two or more inflow control devices, or comprises forcing a protrusion through the barrier in each the two or more inflow control devices.

15. The method according to claim 14, wherein the step of preventing further comprises cycling the pressure in the well tools between at least a first pressure and a second pressure, wherein the first and second pressures are below the actuation pressure.

16. The method according to claim 14, further comprising decreasing the pressure in the well tools, thereby removing a blockage in each of the two or more inflow control devices and permitting fluid flow through the two or more inflow control devices in response to the removal of the blockage, wherein the step of decreasing is performed after the step of increasing.

17. The method according to claim 16, wherein the blockage comprises the barrier or the protrusion.

18. The method of claim 14, wherein the forcing the protrusion through the barrier in each of the two or more inflow control devices maintains the actuation pressure until the actuation pressure is reduced to a second pressure to allow fluid to flow through first flow passage.

19. The method of claim 14, wherein the deforming the barrier in the two or more inflow control devices the actuation pressure until the actuation pressure is reduced to a second pressure to allow fluid to flow through first flow passage.

20. The method of claim 14, wherein the piston is configured with a second flow passage therethrough.

* * * * *